United States Patent [19]

Rowley

[11] 4,066,287

[45] Jan. 3, 1978

[54] SLING ASSEMBLY FOR LIFTING SHEET MATERIAL

[75] Inventor: James R. Rowley, Freeport, Pa.

[73] Assignee: PPG Industries, Inc., Pittsburgh, Pa.

[21] Appl. No.: 703,167

[22] Filed: July 7, 1976

[51] Int. Cl.[2] ..... B66C 1/16

[52] U.S. Cl. ..... 294/74; 294/67 E

[58] Field of Search ..... 294/67 R, 67 B, 67 BA, 294/67 BB, 67 D, 67 DB, 67 E, 67 EA, 74, 75, 77, 81 R; 206/451, 453; 214/1 S, 1 H, 10.5 R; 217/66, 69; 224/45 N, 49, 55

[56] References Cited

U.S. PATENT DOCUMENTS

| | | | |
|---|---|---|---|
| 2,452,392 | 10/1948 | Philbin | 294/74 X |
| 2,792,252 | 5/1957 | Ernst | 294/74 |
| 3,493,128 | 2/1970 | Silvert | 294/67 R X |
| 3,709,358 | 1/1973 | Andrews et al. | 206/451 |
| 3,765,543 | 10/1973 | Thomas | 294/74 X |
| 3,838,779 | 10/1974 | Dawson | 294/67 BB X |
| 3,913,965 | 10/1975 | Muller et al. | 294/67 R |

FOREIGN PATENT DOCUMENTS

| | | | |
|---|---|---|---|
| 1,280,690 | 12/1962 | France | 294/74 |

*Primary Examiner*—Johnny D. Cherry
*Attorney, Agent, or Firm*—Donald Carl Lepiane

[57] ABSTRACT

A glass pack tilted against a support member is lifted by a sling assembly including a spreader bar, a pair of slings each having a half bridle and a protective shoe. Each of the slings includes (1) a first strap portion having its course along one side of the pack, over the shoe, and around the bottom edge of the pack and (2) a second strap portion secured to the end of the first strap portion. The free ends of the slings are secured to the spreader bar and spaced relative to one another to engage the pack at its 1/5 points.

The half bridle has one end secured to the second strap portion with its second end engaging the adjacent side of the pack to prevent racking of the pack when handled by the sling assembly.

The shoe has a generally U shaped configuration and a pair of spaced pins each rotatably mounted between opposed legs. The rotatably mounted pins facilitate movement of the first strap portion when the stack is lifted by the sling assembly from the tilted position to an upright position.

16 Claims, 9 Drawing Figures

FIG. 1
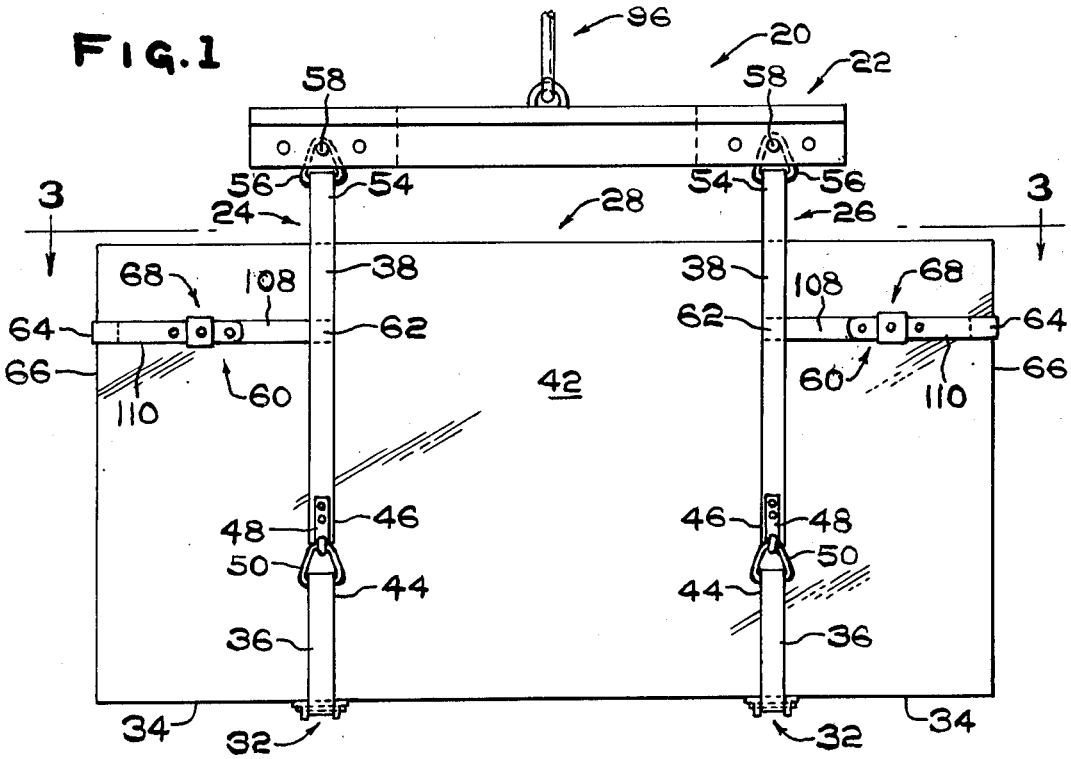
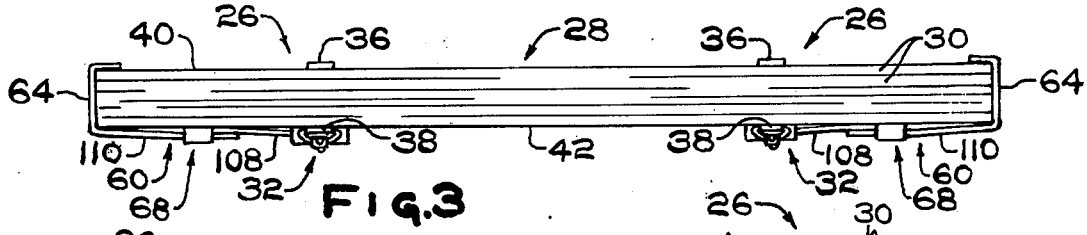
FIG. 3
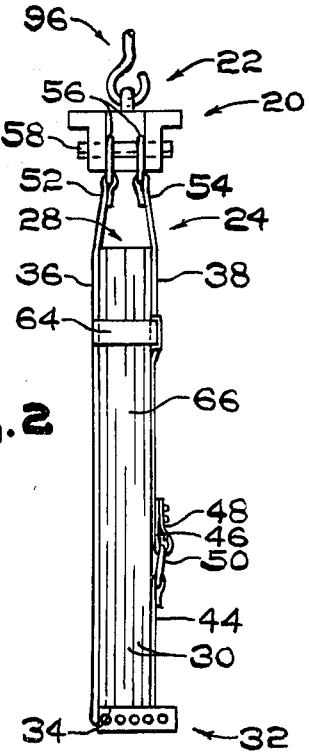
FIG. 2
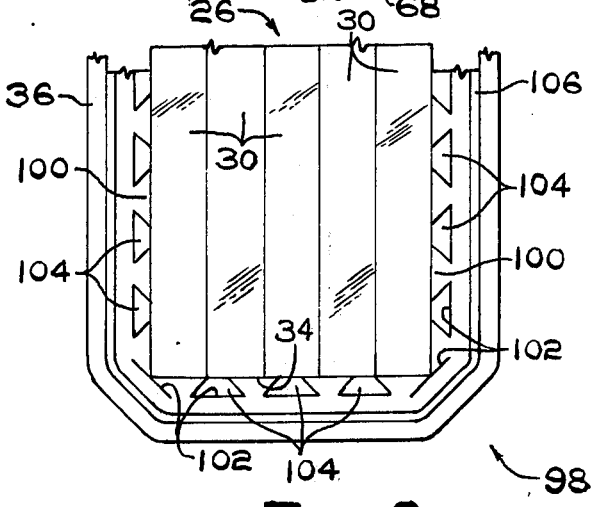
FIG. 8
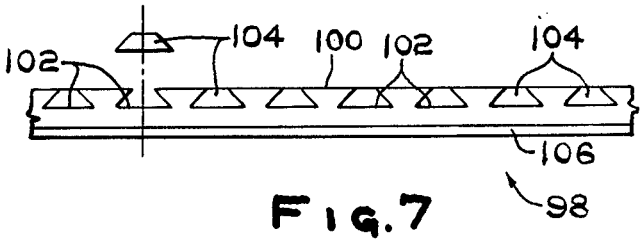
FIG. 7

FIG. 5a
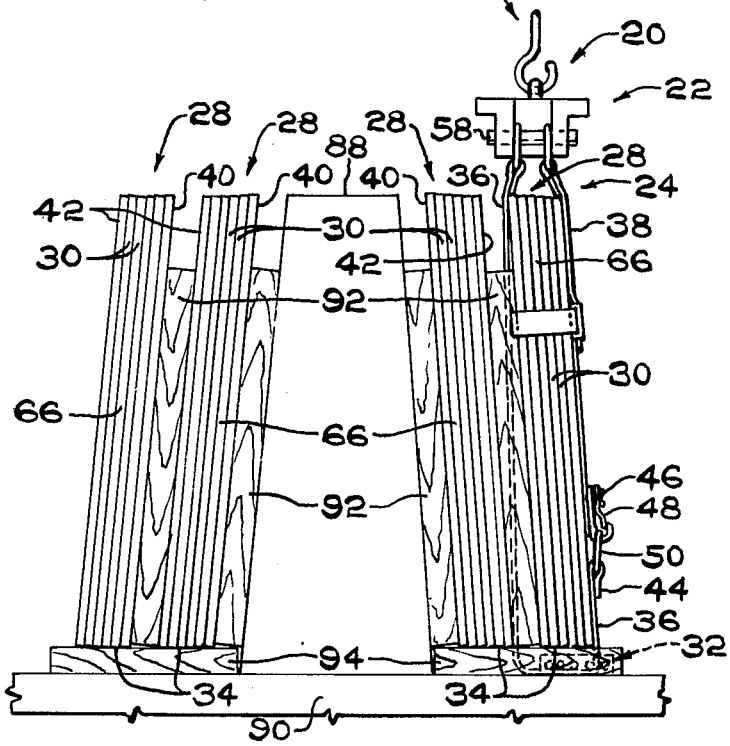
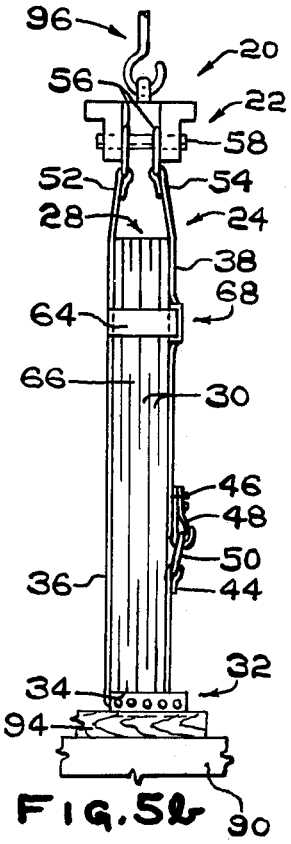
FIG. 5b
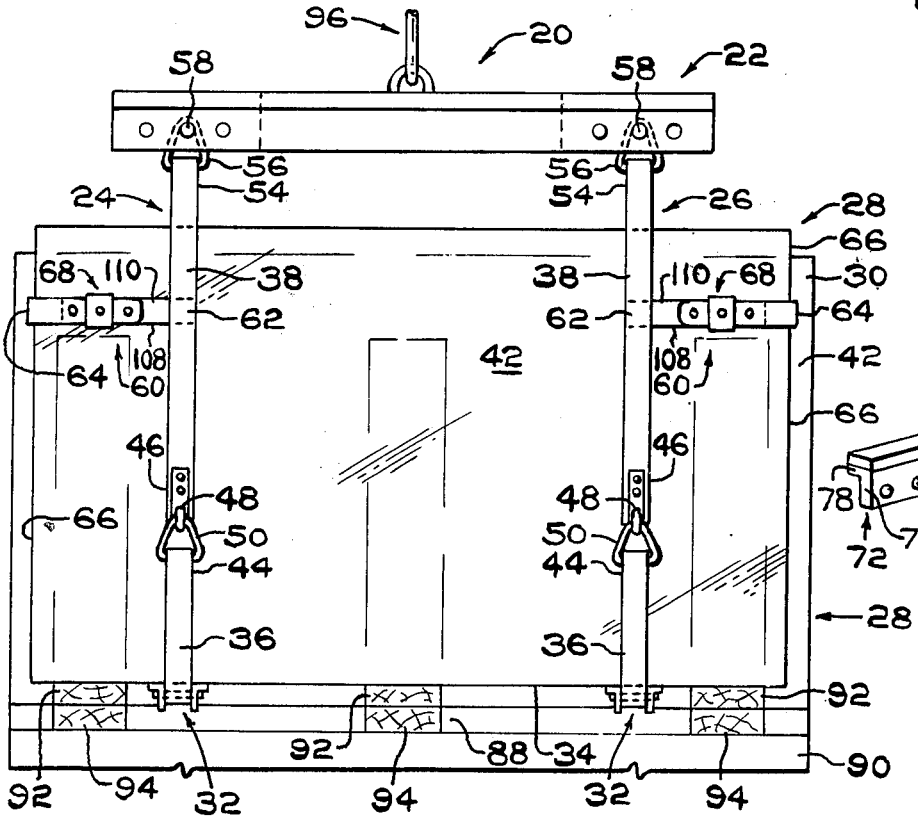
FIG. 6
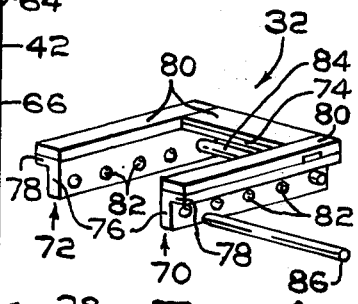
FIG. 4

SLING ASSEMBLY FOR LIFTING SHEET MATERIAL

BACKGROUND OF THE INVENTION

1. Field of the Invention

This invention relates to a sling assembly for lifting a pack of loose sheets, e.g., glass sheets.

2. Discussion of the Prior Art and Technical Problems

Glass sheets are shipped from a glassmaking plant to a fabrication plant by truck or railcar. In general, packs of loose glass sheets are loaded in a generally vertical position supported on deck runners against a back supporting frame. The packs are separated from one another and from the supporting frame by vertical runners to facilitate removal of the packs by a sling assembly. Normally the packs are tilted 5° from the vertical plane for packing stability.

The prior art sling assemblies, e.g., as taught in U.S. Pat. No. 3,838,779 include a spreader bar having a carrying yoke adapted to be supported by a hoist. A pair of slings made of polyester webbing are adapted to be looped over the spreader bar at their upper ends and looped under the glass packs at their lower ends. The bottoms of slings are provided with protective plates (1) made from steel to prevent the glass edges from cutting the sling material and (2) coated with rubber to prevent damage to the glass edges. At the midpoint of each sling is secured a horizontal strap that secures the edges of the glass pack to prevent racking and subsequent slippage.

Although the sling assembly taught in the above-mentioned U.S. Pat. is acceptable for lifting glass packs, there are limitations.

As previously mentioned, the glass packs are separated from one another by vertical runners. These vertical runners limit the insert distance of the slings looped under the sides of the pack.

The distance of the vertical runners from adjacent sides of the pack is selected to prevent bending forces from acting on the cantilever sides of the glass pack during transit. However, this distance is not the same to minimize bending forces so as not to excessively bow the glass pack when handled by the sling assembly.

For example, packs of 5 glass plates each about 130 inches (3.3 meters) by 180 inches (4.6 meters) and 1/8 inch (0.32 centimeters) thick have vertical runners spaced about 10–16 inches (25.4–40.6 centimeters) from an adjacent side of the pack. Therefore, the straps of the sling assembly engage the bottom edge of the pack for lifting at a position spaced about 8–14 inches (20.3–35.6 centimeters) from adjacent side of the glass pack.

When the pack is handled by the sling assembly, the pack excessively bows in the center because of excessive unsupported distance between the straps.

The glass pack may be made stiffer by increasing the number of plates, but the packs become uneconomical and unpractical to handle because of the increased weight of the pack, e.g., from 4,000 pounds for 5 glass plates to 10,000 pounds of 12 glass plates. In other words, a hoist or crane of increased weight lifting capacity has to be used.

Another limitation of the prior art sling assemblies is the protective plate that protects the straps against the edges of the glass sheets. The glass packs, as mentioned, are tilted toward the support member for stacking stability. When lifting a glass pack from a tilted position to a vertical or upright position, the straps equalize their length. Normally the protective plates are secured to the strap, therefore movement of the strap tends to shift the protective plate. This shifting of the protective plate can damage the edges of the glass plates.

It would be advantageous therefore to provide a sling assembly that does not have the limitations of the prior art.

SUMMARY OF THE INVENTION

This invention relates to an improved method of lifting a pack of sheets, e.g., glass sheets supported in a generally vertical position including the steps of positioning a pair of slings about the pack and lifting the slings to lift the pack. The improvement includes the steps of positioning a one of the slings about the pack to engage bottom edge of the pack at a distance from adjacent end equal to about one-fifth of the length of the pack and similarly positioning the other one of the slings at a distance from its adjacent end equal to about one-fifth the length of the pack.

This invention also relates to an improved sling assembly for lifting a pack of glass sheets. The sling assembly is of the type having a pair of slings secured in spaced relation on lifting means. The improvement includes that each of the slings includes a first strap section having a first end and a second end and a second strap section having a first end and a second end. The first end of each strap section is secured to the lifting facility. Facilities are provided for securing the second end of each of the strap sections together. A half bridle is captured on one of the strap sections to prevent rocking of the pack.

This invention further relates to a protective shoe for a sling assembly. In one embodiment the protective shoe includes a generally U shaped member having a pair of spaced, corresponding holes on each of the opposed outer legs and a pair of pins captured and rotatably mounted in the holes.

In an alternate embodiment, the protective shoe includes an elongated, flexible member having a plurality of grooves on one surface and a plurality of inserts selectively insertable in the grooves to provide the member with a predetermined shape.

BRIEF DESCRIPTION OF THE DRAWING

FIG. 1 is a frontal view of a pack lifted by a strap assembly incorporating features of the invention;

FIG. 2 is an end view of the pack shown in FIG. 1;

FIG. 3 is a view taken along lines 3—3 of FIG. 1;

FIG. 4 is an isometric view of a protective shoe incorporating features of the invention and used with the sling assembly shown in FIG. 1;

FIG. 5*a* is a side view of a plurality of packs supported on a flat bed and having the sling assembly of the instant invention positioned to lift one of the packs;

FIG. 5*b* is a side view illustrating the pack supported in the vertical position above the flat bed;

FIG. 6 is a front view of the pack as shown in FIG. 5*a;*

FIG. 7 is a partial frontal view of an alternate type of protective shoe that may be used in the practice of the invention; and FIG. 8 is a view of the protective shoe shown in FIG. 7 arranged in the fixed position about the bottom of a pack to be lifted in accordance to the teachings of the invention.

DESCRIPTION OF THE INVENTION

This invention relates to a sling assembly for and method of lifting a pack of sheets, e.g., glass sheets.

In the following discussion, like numerals refer to like elements.

With reference to FIGS. 1–3, sling assembly 20 includes a spreader bar 22 of the type used in the art having slings 24 and 26 incorporating features of the invention secured thereto and looped around a pack 28 of glass sheets 30 for handling same. A protective shoe 32 incorporating features of the invention is urged against bottom edge 34 of the pack 28 to protect the glass edges against damage and prevent cutting of the slings by the glass edges.

Each of the slings 24 and 26 includes a first strap portion 36 and a second strap portion 38. As shown in FIGS. 2 and 3, the first strap portion 36 has its course downward around back surface 40 of the pack 28 as loaded, around the protective shoe 32 and up the front surface 42 of the pack 28. The second strap 38 has its course downward over the front surface 42 of the pack 28 and has its end 46 secured to end 44 of the first strap portion 36 in any conventional manner. For example, and with reference to FIG. 1, the end 46 of the second strap portion 38 may be provided with latch 48 for receiving triangular loop 50 secured to the end 44 of the first strap portion 36. To prevent marring of the glass surface 42, it is recommended that a section of a strap portion be extended to lay between the latch 48 and the front surface 42 of the pack 28.

Opposed ends 52 and 54 of the strap portions 36 and 38, respectively, are each advantageously provided with a triangular loop 56 for securing the slings 24 and 26 to the spreader bar 22 by way of pins 58 as shown in FIG. 2.

The strap portions 36 and 38 may be made of cloth, e.g., polyester webbing or metal.

A horizontal strap or half bridle 60 has an end 62 secured in any conventional manner to each of the second strap portions. For example, the end 60 may be provided with a loop for receiving the second strap portion 38. The half bridles 60 shown in FIG. 1 are attached to the second strap portion 38.

The other end of the half bridles 60 has a rigid U shaped member 64 for engaging sides 66 of the pack 28. The contacting surface of the member 64 is preferably covered to prevent marring or chipping of the glass plates 30.

Although not limiting to the invention, it is recommended that the half bridles 60 be provided for length adjustment. This may be accomplished by employing a buckle 68 secured to an end of a bridle for receiving end of the other bridle section as shown in FIGS. 1 and 3.

With reference to FIG. 4, the discussion will now be directed to the protective shoe 32. The shoe 32 includes a pair of spaced outer legs 70 and 72 joined at one end by plate 74. The outer legs 70 and 72 each include a vertical section 76 and a horizontal section 78. The contacting surfaces of the horizontal sections 78 and plate 74 are provided with a resilient material 80, e.g., rubber, to prevent marring of the bottom edge 34 and to frictionally engage the bottom edge 34 of the pack 28. A plurality of spaced aligned holes 82 are provided in each of the vertical sections 76 for receiving pins 84 and 86. The pins 84 and 86 are mounted for rotation and define the course of the first strap portion 36 at the bottom edge 34 of the pack 28.

The plate 74 is inserted from the end of the legs 70 and 72 and the pin 84 extends beyond the plate 74 to provide a slight clearance for the first strap portion to clear the plate 74 without contacting the bottom edge 34 of the pack 28.

The pin 86 is spaced from the pin 84 so that the first strap portion clears the bottom edge 34 of the pack 28 while maintaining the glass plates 30 as a unitized pack.

The discussion will be directed to the use of the sling assembly 20 of the invention for lifting the packs 28. As shown in FIG. 5*a*, the packs 28 are supported in a generally vertical position, tilted toward a back support member 88 mounted on a flat bed 90 of a truck or railcar (not shown). Each of the packs 28 are separated from one another and the support member 88 by spaced vertical runners 92 and spaced from the flat bed 90 by the deck runners 94. The vertical runners 92 are spaced from the sides 66 of the pack 28 to prevent bending forces from acting on the cantilever sides of the pack during transit. Additional vertical runners are provided to prevent center bowing of the pack during transit. The use and positioning of the vertical runners are known in the prior art.

The triangular loops 56 of the slings 24 and 26 are secured to the spreader bar 22 by pins 58. The pins 58 are preferably at a spaced distance equal to about three-fifth the length of the pack 28 as measured between its sides 66.

The second strap section 38 having the half bridle 60 attached thereto is dropped over the front surface 42 of the pack to be lifted. The first strap section 36 of each sling 24 and 26 is dropped between the adjacent packs shown in FIG. 5*a*. The end 44 of the first strap section 36 is passed around the pins 84 and 86 of the protective shoe 32 and has triangular loop 50 inserted in the latch 48 of the second strap section 38. The member 64 of the half bridles 60 are secured to adjacent side 66 of the pack 28.

The sling assembly is lifted by a hoist 96 (partially shown). As the straps 24 and 26 are put into tension, the first strap portion slides about the pins 84 and 86 of the protective shoe. Continual lifting of the sling assembly 20 moves the pack from a tilted position to a vertical position as the first strap portion 36 slides about the pins 84 and 86 of its respective protective shoe 32 to equalize the length of the slings 24 and 26 about the pack.

The pack 28 is moved to its designated position and the sling assembly 20 preferably removed from the pack in the reverse order of application.

The sling assembly of the instant invention has distinct advantages over prior art sling assemblies. The slings of the instant invention can be positioned between vertical runners supporting the pack to be lifted. This is because the slings include strap portions that are joined after encircling the packs. This advantage will be appreciated from the following discussion.

Bending forces act on the packs when lifted by slings. These bending forces tend to bow the center of the pack and the sides of the pack about the slings. This effect is especially noted when the pack is made up of 5 glass plates each having a length of 180 inches (4.6 meters); a width of 130 inches (3.3 meters) and ¼ inch (0.64 centimeters) thick.

It has been found that these bending forces are minimal when the pack is lifted at 1/5 points. In other words, the distance of the slings from adjacent sides of the pack is equal to one-fifth the length of the pack.

The vertical runners on the other hand are spaced from the side of the pack to prevent bending forces from acting on the cantilever sides of the pack during transit. Normally a vertical runner is spaced about 10–16 inches (25.4–40.6 centimeters) from a side of the pack for pack length of about 150–180 inches (3.8–4.6 meters).

To minimize the bending moment, packs having a length of about 150–180 inches (3.8–4.6 meters) should be engaged at positions spaced about 30–36 inches (0.76–.91 meters) from the adjacent edge.

The slings of the prior art, e.g., as taught in U.S. Pat. No. 3,838,779 are made of single strap sections having a horizontal strap to engage the side of the pack. The vertical runners interfere with the horizontal strap to prevent the application of the prior art slings at the one-fifth point.

The instant invention eliminates this problem by separating the sling into two sections and using a half bridle as previously discussed. In this manner, the vertical runner does not interfere with the application of the slings at the one-fifth point of the packs.

Further in the prior art, the protective shoe was a plate urged against the bottom edge of the pack and attached to the sling. Upon lifting the pack, the length of the slings equalized by stacking around the shoe. Often times the shoe would be moved by the slings during the equalization of their length. The shifting of the shoe could cause edge chipping and cutting of the sling.

In the instant invention, the straps slide on the pins 84 and 86 of the protective shoe shown in FIG. 1 keeping the shoe in position against the bottom edge of the pack.

As can now be appreciated, certain modifications may be made to the invention without deviating from its scope. For example, instead of employing strap sections 36 and 38, a single strap may be used having a triangular loop at each end. An end of the strap is passed between the packs and over the front surface of the pack and secured in the spreader bar.

With reference to FIGS. 7 and 8, there is shown a protective shoe 98 incorporating features of the invention. In general, the shoe 98 includes an elongated body of resilient material 100, for example, rubber, having a plurality of spaced grooves 102 formed therein for receiving correspondingly shaped inserts 104. Although the grooves and inserts are shown having a trapezoidal cross-section, the invention is not limited thereto. For example, the grooves and inserts may have a triangular or circular cross-section.

With specific reference to FIG. 8, selected ones of the inserts are removed and the shoe bent around the bottom edge of the pack and held in position by the first strap portion 36.

A layer 106 of generally frictionless material, e.g., a layer of synthetic resin polymers known under the trademark of TEFLON ® may be applied to one surface to facilitate movement of the sling about the shoe.

DETAILED DESCRIPTION OF THE INVENTION

With reference to FIG. *5a*, sling assembly 20 of the invention is used to lift packs 28 of 5 glass plates 30. Each plate has a length of about 180 inches (4.6 meters); a height of about 130 inches (3.3 meters) and a thickness of about 1/8 inch (0.32 centimeters). The packs 28 are shipped on a flat bed 90 of a truck (not shown) in any conventional manner. The glass packs 28 are separated from one another and from the support member 88 by a plurality of vertical runners 92 and from the flat bed 90 by the deck runners 94 of the type used in the art. The vertical runners 92 are spaced about 16 inches (0.91 meters) from adjacent side 66 of the pack and about 74 inches (1.9 meters) from adjacent vertical runners.

With reference to FIGS. 1–3, the sling assembly 20 includes a pair of slings 24 and 26 each having a first strap portion 36, a second strap portion 38 and a half bridle 60. The first strap portion is made of ½ inch (1.27 centimeter) thick and 3 inches (7.62 centimeters) wide polyester webbing 15 feet (4.6 meters) long. A triangular loop 56 is secured to one end 52 and a triangular loop 50 is secured at the other end of the strap portion 36. The second strap portion 38 is also made of the polyester webbing has a length of about 9 feet (2.7 meters). A triangular loop 56 is secured at end 54 and a latch 48 secured at a position spaced about 6 inches (15.2 centimeters) from the other end.

The half bridles 60 each includes a first section 108 having end 62 captured on the second strap section 38 and a buckle 68 secured to the other end. The second strap section 110 of the bridles 60 includes a ¼ inch (0.64 centimeter) thick steel U shaped member 64 mounted within one end and a free end for insertion in a buckle or latch 68 for adjustably securing the bridle sections together.

The U shaped member has a height of about 2 inches (5.08 centimeters), outer legs having a length of about 6 inches (0.15 meters) and spaced about 2 inches (5.08 centimeters) apart.

Referring now to FIG. 4, the protective shoe has a generally U shaped configuration including outer legs 70 and 72 joined together along the top by a ¼ inch (0.64 centimeter) thick plate 74, about 8 inches (20.3 centimeters) in length and 6 inches (15.2 centimeters) wide. Each of the legs are made of ¼ inch (0.64 centimeter) thick angle iron 8 inches (20 centimeters) in length.

Vertical sections 76 of each leg 70 and 72 have a height of about 1.5 inches (3.81 centimeters) and horizontal section 78 of each leg has a width of about 1.5 inches (3.81 centimeters).

The vertical section of each leg 70 and 72 has a plurality of 1 inch (2.54 centimeters) holes on a center-to-center spacing of about 1 inch (2.54 centimeters) for receiving pins 84 and 86. The pins 84 and 86 have a diameter of about ¾ inch (1.91 centimeters) so as to freely rotate in the holes. The pin 86 is captured in the outer hole at the plate end. The pins 84 and 86 are on center-to-center spacing of about 1 inch (2.54 centimeters).

The triangular loops 56 of the slings 24 and 26 are secured to the spreader bar 22 by pins 58 and spaced about 108 inches (2.7 meters) apart. Thereafter, the spreader bar assembly 20 is positioned over the pack to be lifted by a hoist 96.

The end 44 of the first strap section 36 of the sling 24 is passed over the surface 40 of the pack to be lifted, i.e., between adjacent packs. The end 44 is pulled between the bottom edge 34 of the pack and flat bed 90 passed under the pins 84 and 86 of the protective shoe 32 and thereafter between the legs 70 and 72 of the shoe.

The second strap portion 38 is dropped over the front surface 42 of the pack to be handled and the latch 48 secured to the loop 50 of the first strap section.

The member 64 of the bridle is then mounted on the adjacent side 66 of the pack spaced about 2 feet (0.61 meter) from the top edge of the pack and adjusted by way of the buckle 68 to maintain the member 64 against the side of the pack.

The sling 26 is applied to the pack in a similar manner.

As the spreader bar 22 is lifted, the shoe 32 is held against the bottom edge 34 of the pack until tension is applied by the slings 24 and 26. Continued lifting of the sling assembly 20 by the hoist lifts the pack from the deck runners 94. The first strap portion 36 of the slings 24 and 26 moves along the pins 84 and 86 of the protective shoe 32 to equalize the sling lengths as the pack is moved from a tilted position to an upright position as shown in FIG. 5b.

The pack is moved to its designated position and the straps and shoes removed.

The strap assembly 20 is now ready to unload the next pack.

As can be appreciated, the invention is not limited to the above example and that the example is presented for illustration purposes only.

What is claimed is:

1. In a sling assembly for lifting at least one sheet wherein the sling assembly is of the type having a pair of slings secured in spaced relationship on lifting means, the improvement comprising:

each of the slings comprising:

a first strap section having a first end and a second end, the first end secured to the lifting means;

a second strap section having a first end and a second end, the first end secured to the lifting means;

means for securing the second end of each of said strap sections together;

and a half bridle having a first end and a rigid second end, the first end secured to the first strap section and the second end of said half bridle engageable with adjacent end of the at least one sheet terminating short of the second strap section.

2. The improved sling assembly as set forth in claim 1 further including a protective shoe for each of the slings.

3. The improved sling assembly as set forth in claim 2 wherein said protective shoe includes:

a pair of spaced apart members; and a pair of pins mounted between said pair of spaced apart members.

4. The improved sling assembly as set forth in claim 3 wherein said pins are rotatably mounted in said pair of spaced apart members and the surface of said shoe contacting the at least one sheet is covered with a resilient material.

5. The improved sling assembly as set forth in claim 2 wherein said protective shoe includes:

an elongated member of flexible material having a plurality of spaced grooves therein of a predetermined shape said grooves extending between sides of said member; and a plurality of inserts of a shape complimentary to the shape of the grooves.

6. The improved sling assembly as set forth in claim 5 wherein said protective shoe further includes:

a layer of low friction material on a surface of said elongated member engaged by the slings.

7. The improved sling assembly as set forth in claim 1 wherein the at least one sheet is a pack of glass sheets.

8. In a sling assembly for lifting a pack of sheets wherein the sling assembly is of the type having a pair of slings secured in spaced relationship on lifting means, the improvement comprising:

each of the slings, comprising:

a first sling section having a first end and a second end, the first end of said first sling section secured to the lifting means;

a second sling section having a first end and a second end, the first end of said second sling section secured to the lifting means;

means for securing the second end of each sling section together; and a half bridle comprising:

a first strap section having a first and second end, the first end having a U shaped configuration;

a second strap section having a first and a second end, the first end of said second strap section secured to one of the sling sections; and means for securing the second ends of the first and second strap sections together and for adjusting the length of the half bridle.

9. A protective shoe for a sling, comprising:

a generally U shaped member having first and second legs joined together by a third leg and a pair of spaced corresponding holes in each of the first and second legs; and a pair of elongated members rotatably mounted in the holes of the first and second legs of said U shaped member wherein the sling passes between the first and second legs of said U shaped member and has its course defined by said elongated members.

10. The protective shoe as set forth in claim 9 further including a resilient material mounted on selected surfaces of said U shaped member.

11. A protective shoe for a sling assembly, comprising:

an elongated flexible member having opposed major surfaces, and opposed sidewalls; ; and a plurality of grooves formed in said member, said grooves extending through a one of the major surfaces and through at least one of the sidewalls; and at least one insert insertable through the at least one sidewall into at least one of the grooves to provide said member with a predetermined shape.

12. The protective shoe as set forth in claim 11 wherein the grooves have a trapezoidal cross-section and said at least one insert has a corresponding cross-sectional configuration.

13. The protective shoe as set forth in claim 12 further including a layer of low friction material on the other major surface of said flexible member.

14. A method of lifting at least one sheet having a pair of opposed major surfaces, the at least one sheet supported in a generally vertical position, comprising the steps of:

providing a first sling and a second sling, each sling having first and second sling sections and an end of half bridle secured to a one of the sling sections;

positioning the first sling sections of the first and second slings around a major surface of the at least one sheet in spaced relation to one another and the second sling sections of the first and second slings in spaced relation to one another on the other major surface of the at least one sheet;

securing ends of the first and second sling sections of the first and second slings together to form a pair of slings in spaced relation to one another about the at least one sheet; and mounting the half bridle on adjacent side of the at least one sheet with the half bridle terminating short of adjacent sling section.

15. The method as set forth in claim 14 including the step of positioning a protective shoe between each of the slings and bottom edge of the at least one sheet.

16. The method as set forth in claim 14 wherein the at least one sheet is a pack of glass sheets.

* * * * *